US012303076B2

(12) United States Patent
Chen et al.

(10) Patent No.: US 12,303,076 B2
(45) Date of Patent: May 20, 2025

(54) APPARATUS AND METHODS FOR DISPENSING DISPOSABLE SHEETS

(71) Applicant: Terraboost Media LLC, Cheyenne, WY (US)

(72) Inventors: Zhiyang Chen, Shenzhen (CN); Brian Morrison, Penuelas, PR (US)

(73) Assignee: Terraboost Media LLC, Cheyenne, WY (US)

( * ) Notice: Subject to any disclaimer, the term of this patent is extended or adjusted under 35 U.S.C. 154(b) by 233 days.

(21) Appl. No.: 18/113,486

(22) Filed: Feb. 23, 2023

(65) Prior Publication Data

US 2024/0285131 A1 Aug. 29, 2024

(51) Int. Cl.
*A47K 10/32* (2006.01)

(52) U.S. Cl.
CPC ..... *A47K 10/32* (2013.01); *A47K 2010/3266* (2013.01)

(58) Field of Classification Search
CPC ..... A47K 10/32
USPC ..... 221/33–63
See application file for complete search history.

(56) References Cited

U.S. PATENT DOCUMENTS 10,806,310 B2 * 10/2020 Mann ..... B65D 83/08
2010/0163569 A1 * 7/2010 Parker ..... A47K 10/46 221/45

* cited by examiner

*Primary Examiner* — Gene O Crawford
*Assistant Examiner* — Ayodeji T Ojofeitimi
(74) *Attorney, Agent, or Firm* — Quantum Patent Law Firm; Seongyoune Kang

(57) ABSTRACT

A dispenser comprises a bowl, a dome and a cap. The bowl includes a base with an aperture extending therethrough and a rounded recess in communication with the aperture. The dome is dimensioned so as to be partially accommodated inside the bowl. The dome includes a curved top portion with a hole forming a nozzle, and further includes a bottom portion configured to be seated within the rounded recess. The cap includes an opening and is configured to be affixed to the bowl such that the dome is secured between the bowl and the cap and such that a part of the curved top portion protrudes through the opening. A ball-and-socket connection is formed once the dome is secured inside the bowl by the cap such that an orientation of the hole can be adjusted by the movement of the dome relative to the dispenser.

12 Claims, 6 Drawing Sheets

APPARATUS AND METHODS FOR DISPENSING DISPOSABLE SHEETS

BACKGROUND OF THE INVENTION

Field of the Invention

The present disclosure relates to apparatus and methods of dispensing items and, more specifically, apparatus and methods of facilitating the dispensing of disposable sheets.

Description of the Related Art

Wipe dispensers have become commonplace to help prevent the spread of germs and bacteria and can be found in gyms, shopping malls, airports, grocery stores, schools, hospitals, and other public or commercial places nowadays. Wipe dispensers are often used by passersby who wish to sanitize their hands and surfaces of one's belongings. Due to its placement in high-traffic areas, the wipe dispensers may also serve a secondary function such as trash collection, advertisement, dispensing of other items, etc. The wipe dispensers should allow the wipes to be easily dispensed without delaying the flow of passersby. In this regard, the wipe dispensers should be easy to maintain and simplify maintenance tasks such as refilling of wipes, replacement of any parts, or emptying of discarded items. Therefore, a wipe dispenser that is to be placed in high-traffic areas should be designed in view of the aforementioned considerations.

SUMMARY OF THE INVENTION

In one example embodiment, an apparatus for dispensing wipes comprises a container and a dispenser. The container includes a compartment configured to store disposable sheets and includes an outer surface including a compartment opening through which disposable sheets are dispensed. The dispenser is mounted on the outer surface and comprises a bowl, a dome and a cap. The bowl includes a base with an aperture extending therethrough and a rounded recess in communication with the compartment through the aperture. The bowl is mounted on the container such that the aperture is aligned with the compartment opening. The dome is dimensioned so as to be partially accommodated inside the bowl. The dome includes a curved top portion with a hole forming a nozzle, and further includes a bottom portion configured to be seated within the rounded recess. The cap includes an opening and is configured to be affixed to the bowl such that the dome is secured between the bowl and the cap and such that a part of the curved top portion protrudes through the opening. A ball-and-socket connection is formed once the dome is secured inside the bowl by the cap such that an orientation of the hole can be adjusted by the movement of the dome relative to the dispenser during dispensing of disposable sheets. The disposable sheets are dispensable from the compartment through the aperture of the bowl and the hole of the dome.

In another example embodiment, a dispenser comprises a bowl, a dome and a cap. The bowl includes a base with an aperture extending therethrough and a rounded recess in communication with the aperture. The dome is dimensioned so as to be partially accommodated inside the bowl. The dome includes a curved top portion with a hole forming a nozzle, and further includes a bottom portion configured to be seated within the rounded recess. The cap includes an opening and is configured to be affixed to the bowl such that the dome is secured between the bowl and the cap and such that a part of the curved top portion protrudes through the opening. A ball-and-socket connection is formed once the dome is secured inside the bowl by the cap such that an orientation of the hole can be adjusted by the movement of the dome relative to the dispenser.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
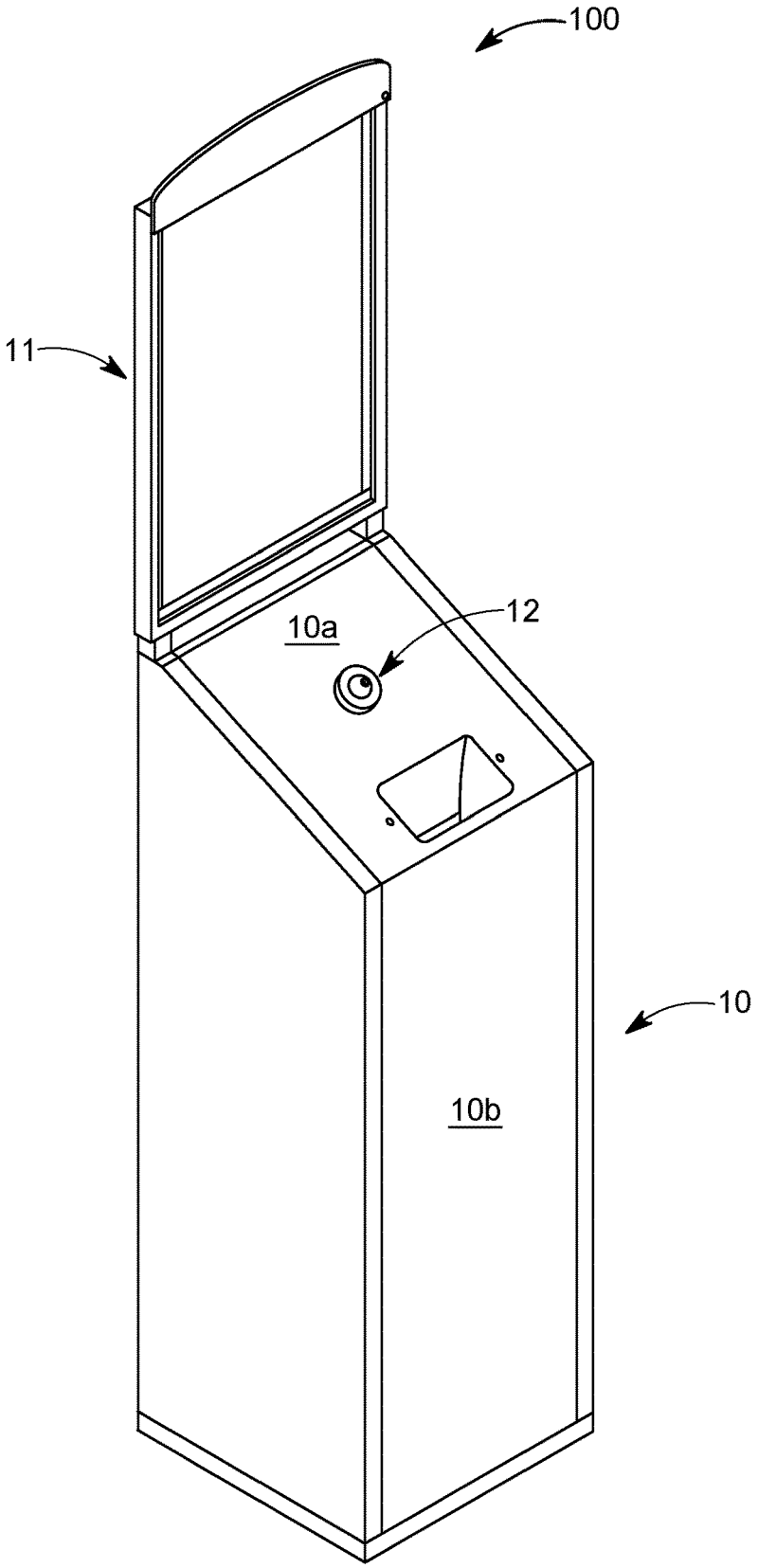
FIG. 1A is a perspective view of an example embodiment of an apparatus in accordance with the present disclosure.
Figure 1B:
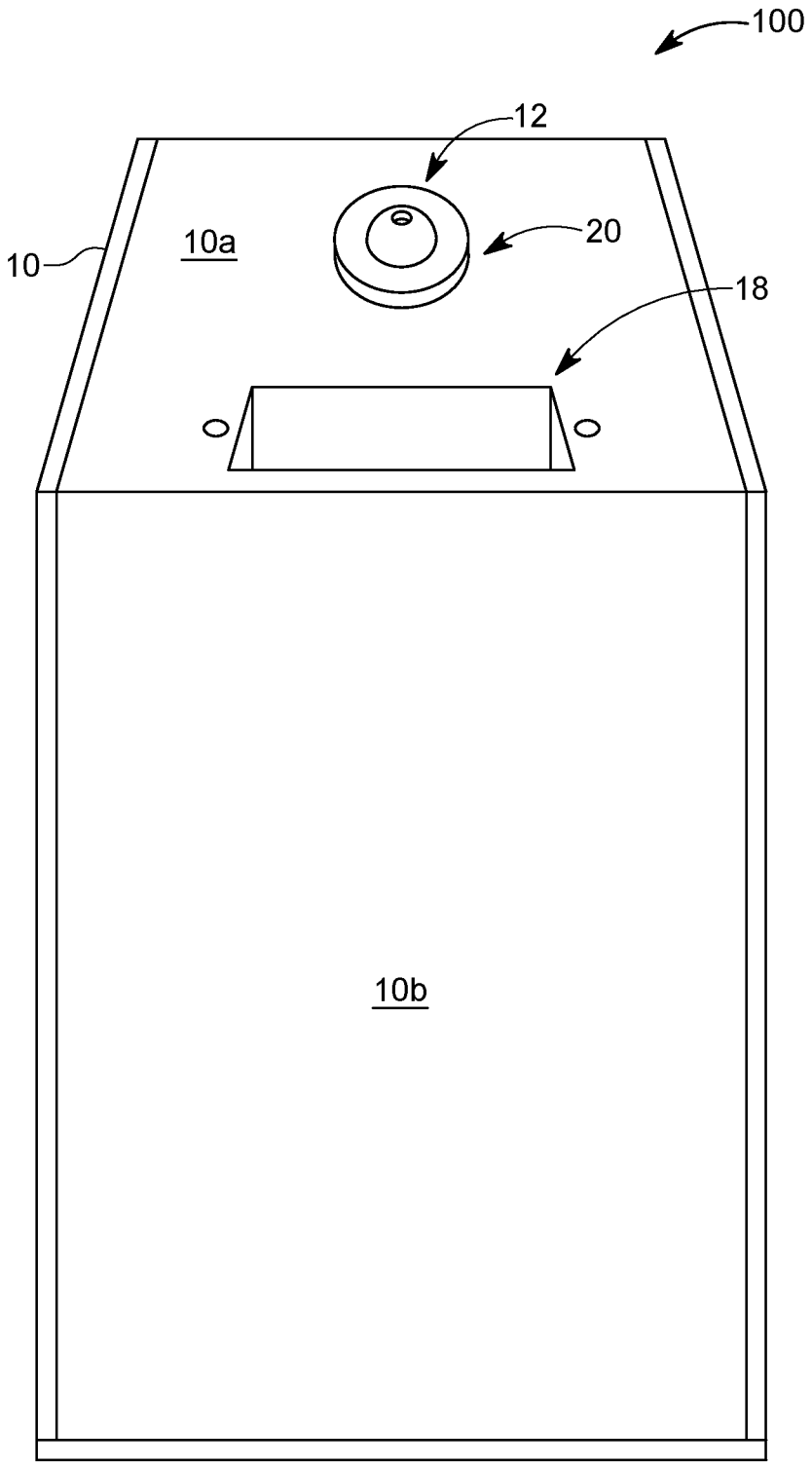
FIG. 1B is a front view of an apparatus including a container and a dispenser.

FIGS. 1A-1B illustrate an example embodiment of an apparatus 100 in accordance with the present disclosure. The apparatus 100 may be configured as a kiosk with a display board 11 and may include a container 10 and a dispenser 12. The container 10 may include a compartment 14 in which disposable sheets are stored. The disposable sheets 16 (shown in FIGS. 6A-6C) may be a roll of wet wipes, dry wipes, cleansing wipes, antibacterial wipes, makeup removal wipes, flushable wipes, or likewise. The disposable sheets 16 may instead be other disposable items such as masks, tissues, or gloves. The disposable items may be arranged in a roll, a stack, a pack, or in any manner that facilitates dispensing from inside the container 10.

In the present embodiment, the container 10 also includes a receptacle 18 serving as a trash, a recycle bin or a combination thereof, such that the disposable sheets 16, once used near the apparatus 100, may be discarded in the receptacle 18. The container 10 may have a shape similar to a box with side surfaces, a bottom surface, and a top surface. An outer surface 10*a* of the container 10, on which the dispenser 12 is mounted and on which an opening of the receptacle 18 is provided, may correspond to the upper surface of the container 10, as shown in FIGS. 1A-1B. The side surfaces of the container 10 may include a front surface 10*b* among others. The front surface 10*b* and/or the upper surface 10*a* may include labels or images with information about the content or the purpose of the apparatus 100. In one example embodiment, the outer surface 10*a* may be an even surface that is sloped relative to the ground or floor on which the example apparatus 100 is placed. The outer surface 10*a* may be oriented to slope downward from the rear surface to the front surface 10*b* of the container 10. However, in other embodiments, the outer surface 10*a* may be an even surface that is parallel relative to the ground or the floor. The outer surface 10*a* may include a compartment opening 20 at which the dispenser 12 is mounted and through which the disposable sheets 16 are dispensed out of the compartment.

Figure 3:
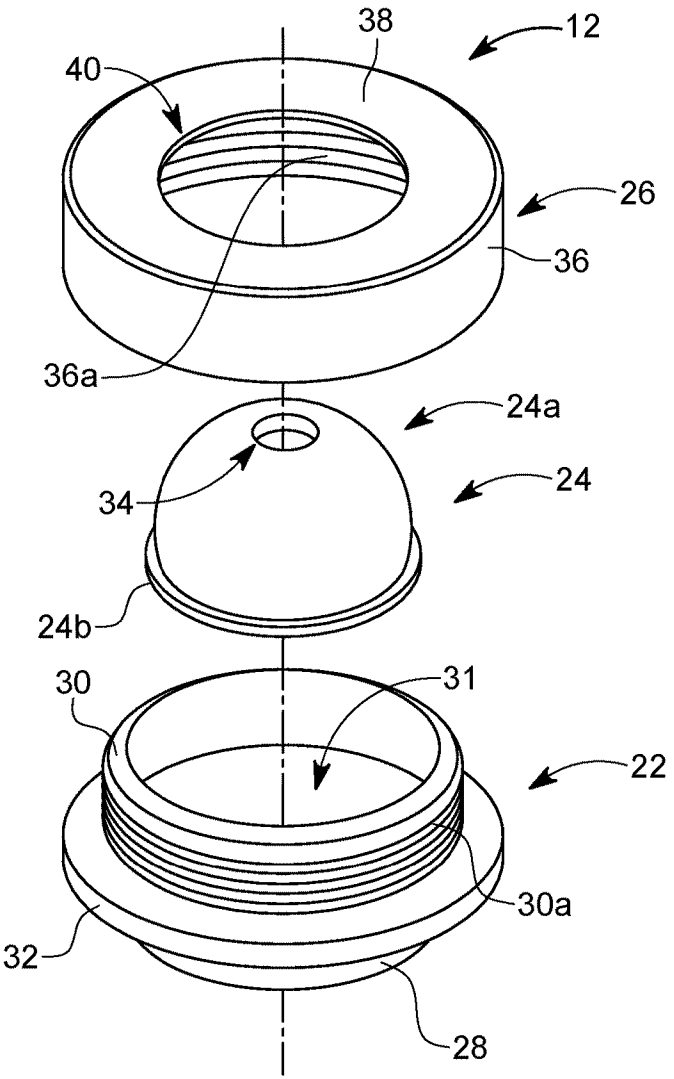
FIG. 3 is an exploded view of the dispenser from FIG. 2 illustrating a cap, a dome and a bowl.
Figure 2:
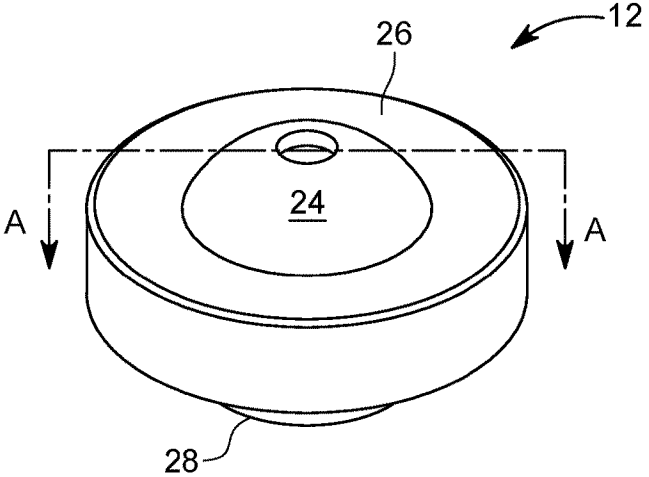
FIG. 2 is a view of the dispenser, in accordance with the present disclosure, detached from the container.
Figure 4A:
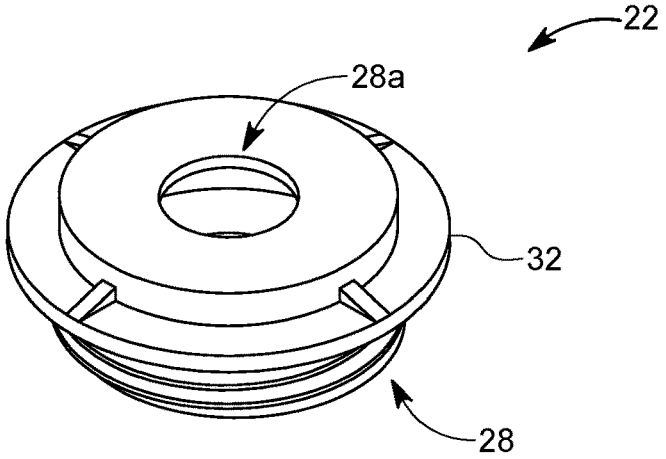
FIG. 4A is a top, perspective view of the bowl of the dispenser in an upside-down state.
Figure 4B:
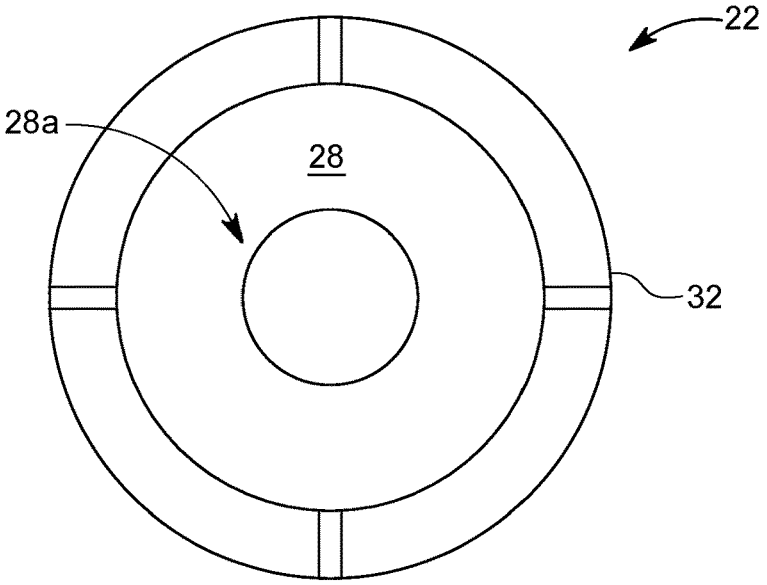
FIG. 4B is a bottom view of the bowl from FIG. 4A.
Figure 4C:
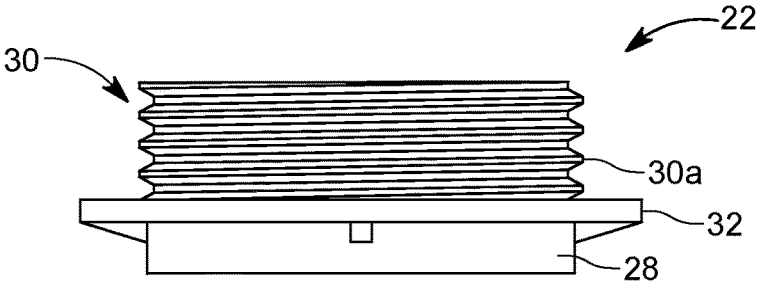
FIG. 4C is a side view of the bowl from FIG. 4A.

In the present embodiment, the dispenser 12 includes a bowl 22, a dome 24 and a cap 26, as shown in FIGS. 2-3. The bowl 22 of the dispenser 12 may be mounted at the compartment opening 20, as shown in FIGS. 1A-1B, in a variety of ways known in the art such as by using a threaded connection, a snap-fit connection, a press-fit connection, adhesives, or the like. As shown in FIGS. 4A-5B, the bowl 22 may include a base 28, a first peripheral wall 30, and a rim portion 32 all of which combine to impart a cylindrical configuration to the bowl 22. The base 28 may include an aperture 28*a* (FIGS. 4A-4B) extending therethrough and configured to be aligned with the compartment opening 20 when the base 28 is mounted on the container 10 thereby allowing the dispenser 12 to be in communication with the compartment. As shown in FIG. 4C, the rim portion 32 may extend radially from the base 28, and the dispenser 12 may be mounted so that the rim portion 32 abuts against an inner surface of the compartment and the first peripheral wall 30 extends through the compartment opening 20. The rim portion 32 may be strengthened by struts extending between the base 28 and the rim portion 32. The first peripheral wall 30 may be configured to surround the base 28 and an outer surface 30*a* of the first peripheral wall 30 may have a threaded configuration, as shown in FIG. 4C.

Figure 5A:
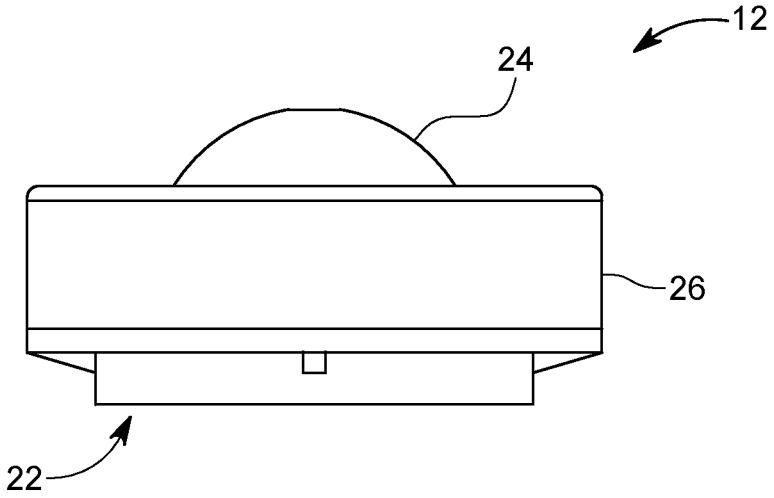
FIG. 5A is a side view of the dispenser from FIG. 2.
Figure 5B:
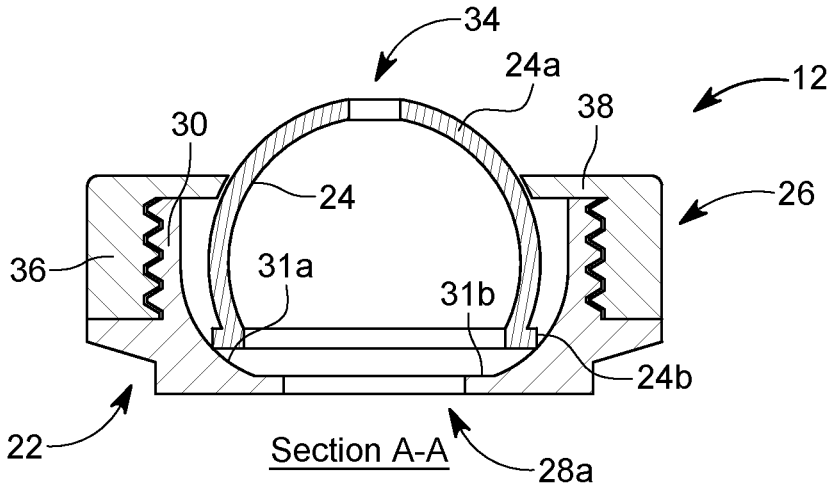
FIG. 5B is a cross-sectional side view of the dispenser from FIG. 2 along plane A-A.

The bowl 22 may further include a rounded recess 31 (FIG. 3) which is surrounded laterally by the first peripheral wall 30 and supported at the bottom by the base 28. As shown in FIG. 5B, the rounded recess 31 may include a rounded portion 31*a* and a flat portion 31*b* surrounding the aperture 28.

As shown in FIG. 3, the dome 24 may include a curved top portion 24*a* and a bottom portion 24*b*. The curved top portion 24*a* may include a hole 34 forming a nozzle of the dispenser 12. The dome 24 may be dimensioned to be at least partially accommodated inside the bowl 22, and the bottom portion 24*b* of the dome 24 may be configured to be seated within the rounded recess 31 of the bowl 22 (FIG. 5B). The bottom portion 24*b* of the dome 24 may be formed in a ring-like shape to facilitate movement of the dome 24 relative to the bowl 22. Specifically, the dome 24 may be configured to be tiltable while maintaining contact with the rounded recess 31 as the bottom portion 24*b* slidingly moves against the rounded portion 31*a*, as shown in FIG. 5B.

As shown in FIG. 3, the cap 26 may have a substantially cylindrical configuration including a second peripheral wall 36 and a top cover 38 provided with an opening 40 formed thereon such that the second peripheral wall 36 surrounds the opening 40. As shown in FIG. 5B, an inner surface 36*a* of the second peripheral wall 36 may be threaded to allow the cap 26 to be screwed onto the bowl 22 whereby the threads on the inner surface 36*a* of the second peripheral wall 36 engage the threads on the outer surface 30*a* of the first peripheral wall 30. Moreover, once the cap 26 is screwed onto the bowl 22 and is affixed thereto, the dome 24 is secured between the bowl 22 and the cap 26, and an upper part of the curved top portion 24*a* of the dome 24 protrudes through the opening 40 (FIGS. 2 and 5A-5B). The opening 40 is dimensioned such that there is some play between the cap 26 and the dome 24 (FIG. 5B).

Figure 6A:
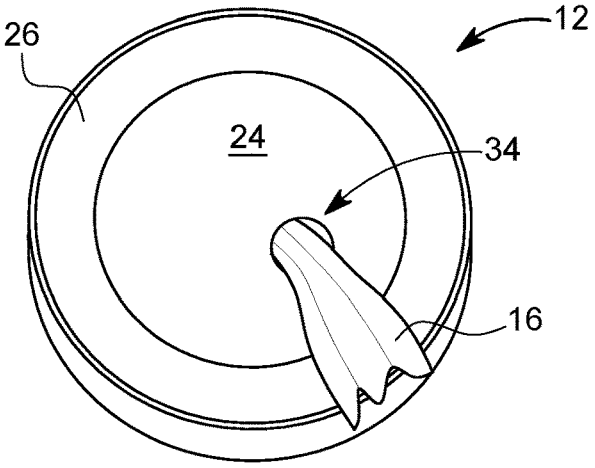
FIG. 6A is a view of a hole on the dome in a first position during dispensing.
Figure 6B:
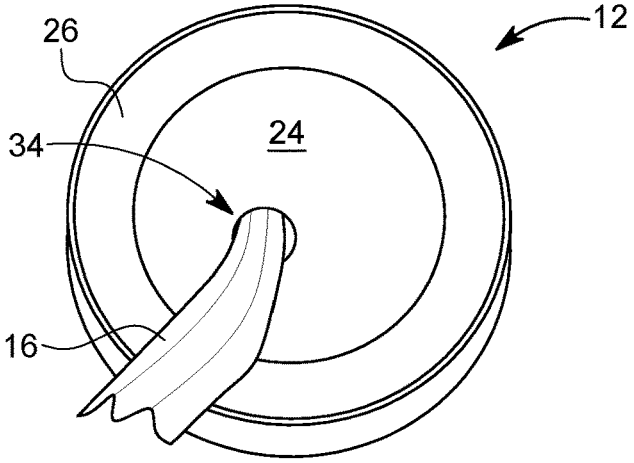
FIG. 6B is a view of the hole on the dome in a second position during dispensing.
Figure 6C:
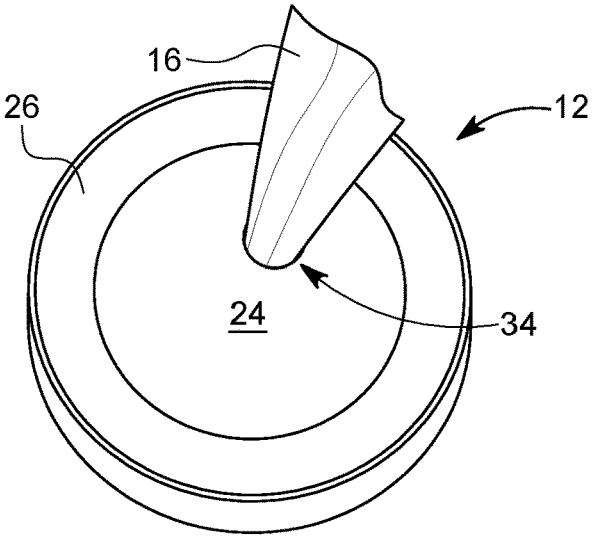
FIG. 6C is a view of the hole on the dome in a third position during dispensing.

The assembly of the cap 26 onto the bowl 22 with the dome 24 therebetween forms a ball-and-socket connection allowing the orientation of the hole 34 to be adjusted by the movement of the dome 24 relative to the bowl 22 and the dispenser 12. Moreover, the roll or stack of disposable sheets 16 may be arranged to extend through the compartment opening 20, the aperture 28 of the bowl 22, and the hole 34 of the dome 24 so that the disposable sheets 16 may be dispensed by pulling. As users pull the disposable sheets 16 from the dispenser 12 in a variety of directions, the dome 24 may be tilted in any peripheral direction and may thereby accommodate the dispensing of the sheets 16 (FIGS. 6A-6C).

Obviously, numerous modifications and variations of the present invention are possible in light of the above teachings. It is therefore to be understood that within the scope of the appended claims, the invention may be practiced otherwise than as specifically described herein.

What is claimed is:

1. An apparatus for dispensing wipes, the apparatus comprising:

a container including a compartment configured to store disposable sheets and including an outer surface including a compartment opening through which disposable sheets are dispensed;

a dispenser mounted on the outer surface and comprising:

a bowl including a base with an aperture extending therethrough and a rounded recess in communication with the compartment through the aperture, the bowl mounted on the container such that the aperture is aligned with the compartment opening;

a dome dimensioned so as to be partially accommodated inside the bowl, the dome including a curved top portion with a hole forming a nozzle, the dome further including a bottom portion configured to be seated within the rounded recess; and a cap including an opening and configured to be affixed to the bowl such that the dome is secured between the bowl and the cap and such that a part of the curved top portion protrudes through the opening, wherein a ball-and-socket connection is formed once the dome is secured inside the bowl by the cap such that an orientation of the hole can be adjusted by the movement of the dome relative to the dispenser during dispensing of disposable sheets, wherein disposable sheets are dispensable from the compartment through the aperture of the bowl and the hole of the dome, and wherein the bottom portion is configured to slide against the rounded recess as the dome is moved relative to the bowl.

2. The apparatus of claim 1, wherein the outer surface of the compartment is a flat, sloped surface located at a top of the compartment.

3. The apparatus of claim 1, wherein the bowl includes a first peripheral wall surrounding the base, the cap includes a second peripheral wall surrounding the opening, an outer surface of the first peripheral wall of the bowl is threaded, and an inner surface of the second peripheral wall of the cap is threaded such that the cap can be screwed onto the bowl.

4. The apparatus of claim 3, wherein the bowl includes a flange that extends radially outward from the first peripheral wall.

5. The apparatus of claim 4, wherein the rounded recess includes a flat portion surrounding the aperture.

6. The apparatus of claim 1, wherein the compartment includes a trash bin for the disposable sheets.

7. The apparatus of claim 1, wherein the dome is adjustable to be oriented toward a direction in which disposable sheets are pulled from the dispenser.

8. A dispenser comprising:

a bowl including a base with an aperture extending therethrough and a rounded recess in communication with the aperture;

a dome dimensioned so as to be partially accommodated inside the bowl, the dome including a curved top portion with a hole forming a nozzle, the dome further including a bottom portion configured to be seated within the rounded recess; and a cap including an opening and configured to be affixed to the bowl such that the dome is secured between the bowl and the cap and such that a part of the curved top portion protrudes through the opening, wherein a ball-and-socket connection is formed once the dome is secured inside the bowl by the cap such that an orientation of the hole can be adjusted by the movement of the dome relative to the dispenser, and wherein the bottom portion is configured to slide against the rounded recess as the dome is moved relative to the bowl.

9. The dispenser of claim 8, wherein the bowl includes a first peripheral wall surrounding the base, the cap includes a second peripheral wall surrounding the opening, an outer surface of the first peripheral wall of the bowl is threaded, and an inner surface of the second peripheral wall of the cap is threaded such that the cap can be screwed onto the bowl.

10. The dispenser of claim 9, wherein the bowl includes a flange that extends radially outward from the first peripheral wall.

11. The dispenser of claim 8, wherein the rounded recess includes a flat portion surrounding the aperture.

12. A dispenser comprising:

a bowl including a base with an aperture extending therethrough and a rounded recess in communication with the aperture;

a dome dimensioned so as to be partially accommodated inside the bowl, the dome including a curved top portion with a hole forming a nozzle, the dome further including a bottom portion configured to be seated within the rounded recess; and a cap including an opening and configured to be affixed to the bowl such that the dome is secured between the bowl and the cap and such that a part of the curved top portion protrudes through the opening, wherein a ball-and-socket connection is formed once the dome is secured inside the bowl by the cap such that an orientation of the hole can be adjusted by the movement of the dome relative to the dispenser, wherein the bowl includes a first peripheral wall surrounding the base, the cap includes a second peripheral wall surrounding the opening, an outer surface of the first peripheral wall of the bowl is threaded, and an inner surface of the second peripheral wall of the cap is threaded such that the cap can be screwed onto the bowl, and wherein the bowl includes a flange that extends radially outward from the first peripheral wall.

* * * * *